United States Patent [19]

Parkinson

[11] 4,410,334

[45] Oct. 18, 1983

[54] HYDROCARBON FUEL COMPOSITION

[76] Inventor: Harold B. Parkinson, Monroe St., Gardner, Ill. 60424

[21] Appl. No.: 316,747

[22] Filed: Oct. 30, 1981

[51] Int. Cl.[3] ..... C10L 1/18

[52] U.S. Cl. ..... 44/56; 44/77

[58] Field of Search ..... 44/56, 77

[56] References Cited

U.S. PATENT DOCUMENTS

| | | | |
|---|---|---|---|
| 2,152,196 | 3/1939 | Kokatnur | 44/9 |
| 2,786,745 | 3/1957 | Stayner et al. | 44/77 |
| 2,807,525 | 9/1957 | Foreman | 44/77 |
| 2,807,526 | 9/1957 | Foreman | 44/77 |
| 2,853,530 | 9/1958 | Banigan, Jr. | 260/615 |
| 2,873,182 | 2/1959 | Kosmin | 52/5 |
| 2,892,694 | 6/1959 | Weeks | 52/5 |
| 2,920,948 | 1/1960 | Weeks | 52/5 |
| 2,987,385 | 6/1961 | Gray | 44/66 |
| 3,232,724 | 2/1966 | Finnigan et al. | 44/66 |
| 3,346,494 | 10/1967 | Robbins et al. | 252/33.2 |
| 3,440,029 | 4/1969 | Little et al. | 44/75 |
| 3,490,237 | 1/1970 | Lissant | 60/217 |
| 3,527,581 | 9/1970 | Brownawell et al. | 44/51 |
| 3,551,461 | 12/1970 | Thayer | 260/493 |
| 3,573,011 | 3/1971 | Gaston | 44/66 |
| 3,606,868 | 9/1971 | Voogd | 123/25 R |
| 3,756,794 | 9/1973 | Ford | 44/51 |
| 3,807,972 | 4/1974 | Miller | 44/51 |
| 3,822,119 | 7/1974 | Frech et al. | 44/51 |
| 3,876,391 | 4/1975 | McCoy et al. | 44/51 |
| 3,902,869 | 9/1975 | Friberg et al. | 44/51 |
| 4,002,435 | 1/1977 | Wenzel et al. | 44/51 |
| 4,046,519 | 9/1977 | Piotrowski | 44/51 |
| 4,083,698 | 4/1978 | Wenzel et al. | 44/51 |
| 4,125,382 | 11/1978 | O'Brien et al. | 44/51 |
| 4,158,551 | 6/1979 | Feuerman | 44/51 |
| 4,162,143 | 7/1979 | Yount | 44/51 |
| 4,173,455 | 11/1979 | Fodor et al. | 44/51 |
| 4,182,614 | 1/1980 | Moriyama et al. | 44/51 |

OTHER PUBLICATIONS

Shinoda et al., Conditions to Product So-Called Microemulsions: Factors to Increase the Mutual Solubility of Oil and Water by Solubilizer, Mar. 10, 1972, pp. 381-387.

Palit et al., "The Blending of Water with Organic Solvents by Detergents", *Journal of Society of Chemical Industry,* vol. 66, pp. 3-5, Jan. 1947.

Palit, "A Note on Mixed Solvent Effect in Solubilization," *Journal of Colloid Science,* vol. 3, pp. 523-524 (1948).

Palit et al., "Solubilization of Water in Non-Polar Solvents by Cationic Detergents", *Proceedings of the Royal Society of London,* vol. 208, pp. 542-551, Sep. 1951.

Palit et al., "Solubilization of Water in Non-Polar Solvents by Detergent Mixtures", *Journal of the Chemical Society, pp. 2129-2134, Apr. 1954.*

*Primary Examiner*—Charles F. Warren

*Assistant Examiner*—Y. Harris-Smith

*Attorney, Agent, or Firm*—Leydig, Voit, Osann, Mayer & Holt, Ltd.

[57] ABSTRACT

A fuel composition having enhanced tolerance for water comprises a hydrocarbon base fuel, a polyether more soluble in the hydrocarbon base fuel than in water, and, optionally, a supplemental fuel component such as, for example, an alcohol.

17 Claims, 2 Drawing Figures

HYDROCARBON FUEL COMPOSITION

Figure 1:
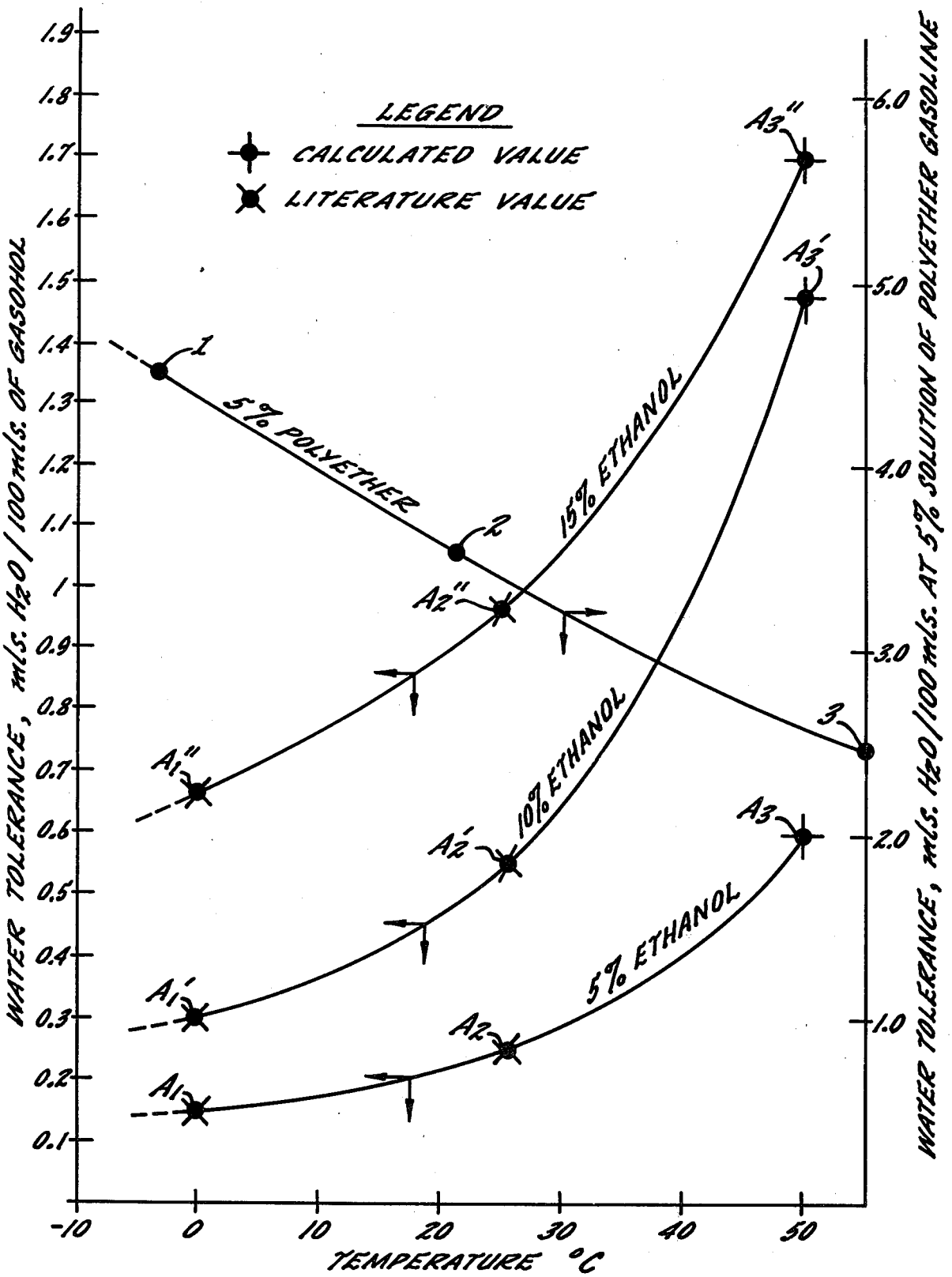

The present invention relates to a liquid hydrocarbon fuel composition, to a method of preparing such a composition and to an additive which imparts improved water tolerance when added to a fuel composition.

BACKGROUND OF THE INVENTION

It has long been recognized that the inclusion of trace amounts of water or small amounts of the lower alcohols in gasoline is advantageous in some respects and deleterious in others. Thus, it has been observed that traces of water contribute to smooth motor performance in conventional spark-ignition engines. Various devices have been developed and employed commercially in fleet operations which inject water vapor into the cylinders along with the air-fuel mixture during stress conditions, such as rapid acceleration or hill climbing to avoid "knock" which is symptomatic of poor efficiency. These devices typically use separate reservoirs of water or water-rich fluids because the water or aqueous fluids have a very low solubility in gasoline at the range of temperatures encountered in both summer and winter driving.

However, the inclusion of trace amounts of water in gasoline in either dissolved or suspended form has also been undesirable for a number of reasons. For example, gasoline saturated with water at ambient temperatures, e.g., 70° F., upon cooling to a lower temperature, e.g., 32° F., can precipitate water either as a liquid or as solid ice causing corrorion, clogged fuel filters, fuel line freeze-up or other malfunctions.

In order to prevent operating difficulties on the part of automobile owners, some refiners add about 1 to 3% of methanol, isopropanol, or other deicers to gasoline so that any water which might separate from the fuel under supersaturated conditions will contain alcohol as an anti-freeze. The addition of de-icers can likewise aggravate the water problem should phase separation into hydrocarbon and aqueous alcohol result.

More recently, for entirely different reasons, there has developed in many areas an incentive or need to include in motor fuels considerably larger amounts of hydrophilic oxycompounds such as methanol, ethanol, acetone and the like. The duel incentive stems from the need to extend available supplies of petroleum and to provide a high octane blending component for lead-free fuels. There is thus incentive to include 5 to 15% or more on a volume basis of such hydrophilic components.

In the United States, the term gasohol typically refers to a blend of 10% by volume ethyl alcohol and 90% by volume unleaded gasoline. However, other percentages and other alcohols, such as methyl and isopropyl, can be used. As used herein, the term gasohol has the broader signification of any blend of a water soluble alcohol or alcohols with a hydrocarbon base fuel.

A gasohol comprised of 10% ethyl alcohol and 90% unleaded gasoline, for example, can be substituted for unleaded gasoline in most cars. Ethyl alcohol has a lower heating value than gasoline, but has a high blending octane number, so that somewhat higher engine compression ratios can be used. The increased engine efficiency obtained when a higher compression ratio is used may offset the reduced heating value of gasohol.

A serious problem with gasohol is that the extremely limited water tolerance of the alcohol component aggravates the phase problem. A relatively small amount of water can cause phase separation in gasohols containing less than 20% alcohol.

The water tolerance of gasoline-alcohol blends depends on the alcohol used, the amount of alcohol in the blend, and on temperature. The greater the concentration of alcohol, the higher is the tolerance for water. For example, the water tolerance of a fuel composition comprising 90% unleaded gasoline and 10% ethyl alcohol is about 0.56 ml. of water per 100 mls. of the blend at 25° C. If the blend contains 5% ethyl alcohol instead of 10%, the water tolerance at 25° C. is not as great—it is only about 0.25 ml. of water per 100 mls. of the blend. If the blend contains 15% ethyl alcohol, the water tolerance at 25° C. is greater—it is about 0.96 ml. of water per 100 ml. of blend.

For a given concentration of alcohol, the tolerance of the blend for water increases with temperature. For example, the water tolerance of a blend of 95% unleaded gasoline and 5% ethyl alcohol is about 0.25 ml. of water per 100 ml. of blend at 25° C., compared to 0.14 ml. of water at 0° C. Similarly, for gasohol containing 10% ethyl alcohol, the water tolerance at 0° C. is only 0.30 ml per 100 ml. of blend, and for gasohol containing 15% ethyl alcohol, the water tolerance at 0° C. is only 0.66 ml per 100 ml. of blend.

There are two major ramifications of the low tolerance of gasohol for water. First, the alcohol used in blending the gasohol must be anhydrous, or nearly anhydrous. Anhydrous ethyl alcohol is significantly more expensive than 90 or 95% ethyl alcohol, and it would therefore be advantageous if the cheaper alcohols could be used. Second, special handling precautions have to be taken to prevent gasohol from coming into contact with water when it is in storage or it is being transported. Resort to on site blending, as opposed to refinery blending, has often been found to be necessary. In addition, gasohol has an increased tendency to cause corrosion, engine starting and operation problems, and fuel line problems due to the difficulty involved in excluding even small quantities of water from automobile fuel tanks in which gasohol is used.

A number of prior patents are directed to liquid fuel mixtures comprised of a hydrocarbon base fuel, water, and an emulsifier. For example, U.S. Pat. No. 3,876,391, U.S. Pat. No. 3,527,581 and U.S. Pat. No. 4,158,551 are directed to such compositions. In some cases, ethoxylated alkylphenols have been disclosed as suitable emulsifiers, or as suitable components in emulsifier mixtures for such compositions. Other prior patents are directed to liquid fuel mixtures comprised of hydrocarbon base fuel, a water soluble alcohol, water, and an emulsifier. For example, U.S. Pat. No. 4,046,519 is directed to such compositions. These prior patents are all directed to compositions that are emulsions or microemulsions. In other words, these patents are directed to compositions in which there are separate aqueous and hydrocarbon phases. While such microemulsions should theoretically be entirely suitable, obvious problems are presented should the emulsions break.

Some investigations have previously been made regarding solubilization of water in pure organic materials such as, for example, cyclohexane, using an ethoxylated nonylphenol mixture. K. Shinoda et al. "Conditions to Produce So-called Microemulsions: Factors to Increase the Mutual Solubility of Oil and Water by Solubilizer," *Journal of Colloid and Interface Science*, Vol. 42, No. 2, pp. 381-387 (February, 1973). Applicant is not aware, however, of any prior work relating to solubilization of water in gasoline, gasohol, or other hydrocarbon base fuels.

Still further, several prior patents concern the use of various polyethers as gasoline additives for various purposes. U.S. Pat. No. 3,232,724 discloses the addition of an ethoxylated octyl- or nonylphenol containing 4 to 16 ethylene oxide units to gasoline in amounts up to 0.01 weight percent to provide carburetor detergency. U.S. Pat. No. 3,573,001 concerns the use of small amounts of a propoxylated alkanoic acid as a deicer. U.S. Pat. No. 3,440,029 similarly shows an ethoxylated alkylphenol containing 1 to 20 ethylene oxide units employed in small amounts as a deicer. U.S. Pat. No. 2,853,530 illustrates a polyether containing 6 ether groups described as having use in gasoline.

SUMMARY OF THE INVENTION

A principal object of the present invention is to provide a stable, homogeneous, fuel composition having an enhanced tolerance for water, particularly at low temperatures.

A related object is to provide a stable, homogeneous, gasohol that can be made by blending a hydrocarbon base fuel with an alcohol, such as 95% ethyl alcohol, that contains some water, without causing separation into aqueous and hydrocarbon base fuel phases.

Yet another object is to provide a stable, homogeneous, gasohol that does not require observance of strict precautions to prevent contact of the fuel with small amounts of water, such as might occur in storage tanks, tank cars, and automobile fuel tanks unless special precautions are taken.

A still further object of this invention provides an additive for a fuel composition capable of imparting enhanced tolerance for water.

Figure 2:
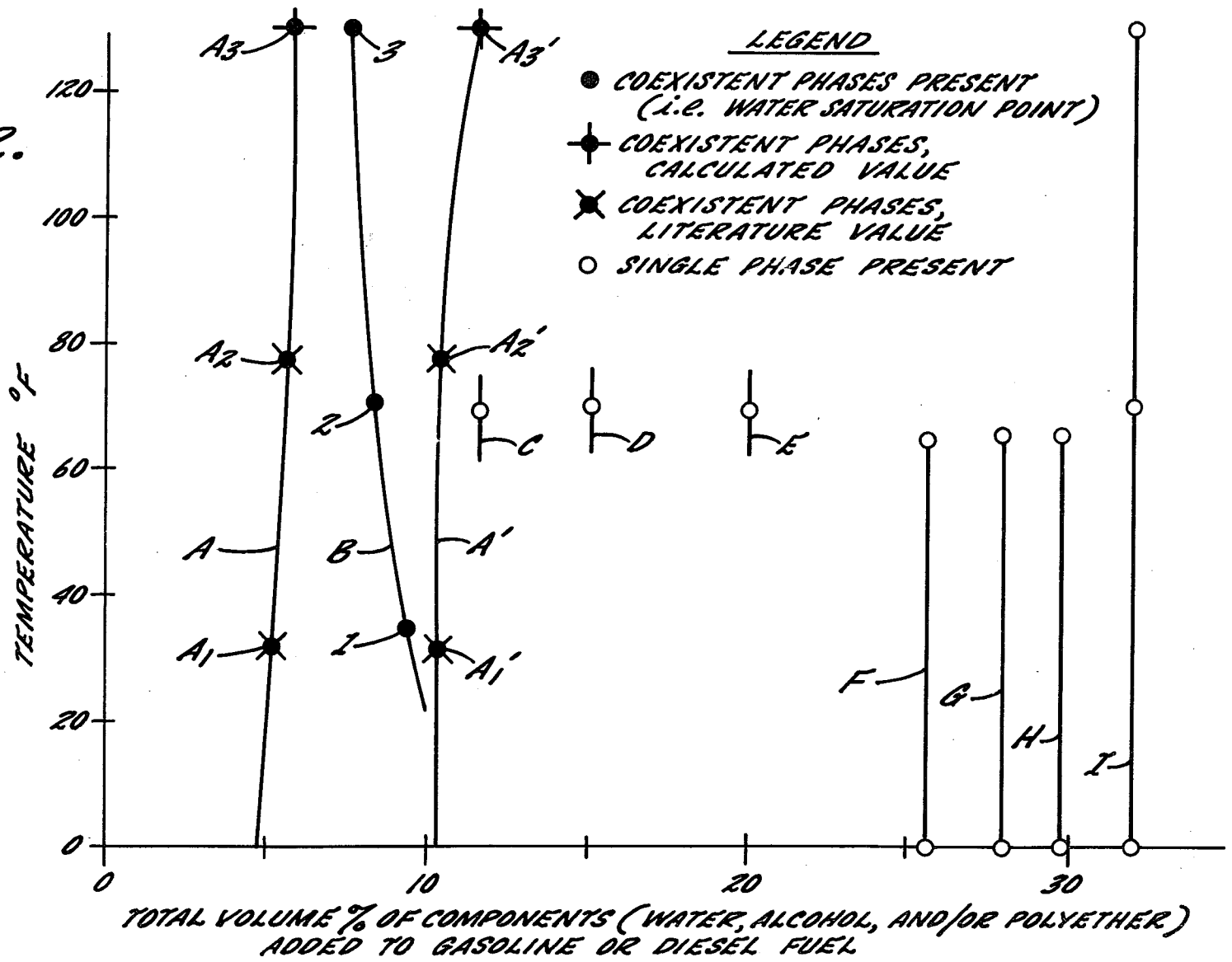

Other objects and advantages of the present invention will become apparent from the following description, and from the drawings in which:

FIG. 1 is a graph of water tolerance versus temperature and illustrating the changing effect of water tolerance as the temperature varies for gasoline having added thereto ethanol or a polyether, and FIG. 2 is a graph of temperature versus the total additives in the gasoline and showing the limited tolerance for water of gasohol compositions in contrast to fuel compositions in accordance with this invention which are stable, single phase compositions over a wide range of temperatures.

While the invention will be described in connection with certain preferred embodiments, it will be understood that it is not intended to limit the invention to these embodiments. On the contrary, it is intended to cover all embodiments, modifications, and equivalents included within the spirit and scope of the invention as defined in the appended claims.

The present invention is predicated on the discovery that the solubility of water in liquid hydrocarbon fuel compositions, such as gasoline and gasohol, is increased when the fuel composition includes, in solution therein, a polyether having particular characteristics as will be described hereinafter. A more specific aspect of this invention resides in the discovery that appropriate blends of the polyether and alcohol can impart to gasohol compositions enhanced water tolerance which is essentially constant over the temperature span encountered in automobile usage.

As used herein, the term tolerance for water refers to the limit of solubility of water in the fuel composition under consideration. Defining this functionally, the limit of solubility is not considered to be exceeded if high speed centrifuging fails to reveal separation of aqueous and hydrocarbon phases. Visually, the solution should be clear after such centrifuging; and as referred to herein, such clear solutions are considered as single phase compositions in which the additives are solubilized in the hydrocarbon base fuel. Two-phase mixtures have a cloudy or hazy appearance when held to a light.

PREFERRED EMBODIMENTS OF THE INVENTION

As a practical matter, it is preferred that the hydrocarbon base fuel component constitute about 80% by volume or more of the fuel composition. While less hydrocarbon base fuel than 80% may be utilized, problems such as the lower heating value of the fuel, and possible distortions in the distillation curve make it less likely that the fuel will be an acceptable substitute in engines designed to use the hydrocarbon base fuel. Gasoline, diesel fuel or any other hydrocarbon base fuel may be employed.

Added to the hydrocarbon base fuel, when desired, is a supplemental fuel component which has a research blending octane number in excess of 100. Such components are well known and may generally be described as hydrophilic, oxygen-containing compounds. Methyl, ethyl and isopropyl alcohol are specific representative examples; and ketones such as acetone are likewise suitable. While commercial availability may be a hindrance, n-propyl alcohol could similarly be utilized.

The amount of such component utilized in the overall fuel composition can be varied as desired. Typically, this component may be present in an amount, based upon the total volume of the fuel composition, of from about 1% up to 20% or more. More preferably, such component is present at a level of from about 2.5% to about 15% by volume.

This component need not be anhydrous. Water can be tolerated so long as the amount present can be solubilized in the fuel composition.

It should be appreciated that mixtures of more than one such component can be employed, if desired. Indeed, it may be desirable to utilize mixtures to improve various performance characteristics. As an example, it may be useful to increase the solubility in the fuel composition of the polyethers used in accordance with this invention by the addition of suitable amounts of t-butyl alcohol, methyl-t-butyl ether, or the like.

In accordance with the present invention, a polyether is incorporated into the fuel composition in an amount sufficient to provide the desired level of water tolerance. From the functional standpoint, useful polyethers should: (1) be more soluble in the hydrocarbon base fuel than in water over the temperature range normally encountered in the end use application, (2) have sufficient capacity in the amounts utilized to absorb the level of water likely to be present yet retain solubility in the fuel composition for the sorbed product, (3) absorb water exothermically, and (4) have an adequate volatility.

With respect to the first requirement, it is desirable, as an example, to utilize a polyether having a solubility in the fuel composition which exceeds its solubillity in water by at least about 50% at 20° C. Virtually all known polyethers are believed to absorb water exothermically, and this is important insofar as absorbing water at low temperatures. The second criteria is another way of stating that a careful balance between the hydrophilic and hydrophobic character of the polyether must be maintained. The polyether must be sufficiently hydrophilic that useful amounts of water are absorbed, yet not be so hydrophilic that the hydrophobic character is insufficient to allow the water-polyether sorbed product to be solubilized in the fuel composition. Lastly, the volatility should be sufficient so that excessive non-volatile residues will not result, for example, in an engine carburetor. As a specific example, a polyether having a boiling point of 400° F. or higher at 5 mm. pressure would probably be unsuitable.

Many polyethers which satisfy such criteria are known. As an example, suitable polyethers include polyalkylene oxide polyethers, such as polyoxyethylene polyethers or homopolymers of butene oxide. Ethoxylated alkylphenols such as polyoxyethylene octylphenols and nonylphenols having about 3 to 5 moles of ethylene oxider per mole of the alkylphenol are suitable. In this type of polyether, a ratio of carbon to oxygen atoms in the range of about 4 or 5:1 will be useful.

The amount of polyether used should be in the range of about 1% to 15% by volume. Below about 1%, the polyether enhances water tolerance somewhat, but generally not to a significant degree. It is generally not practical to add the polyether in an amount greater than 15% because such additions may cause an unduly high concentration of high boiling components in the fuel, and would also be too costly. Preferably, the amount of polyether used is in the range of about 2–5% by volume.

It should be appreciated that mixtures of more than one polyether may be utilized, if desired. As an example, this might be useful to balance the hydrophilic-hydrophobic characteristics desired for a particular application. It is generally preferable, however, to use polyether components that individually have as close as possible to the desired balance of hydrophilic-hydrophobic characteristics.

In accordance with the broadest aspect of this invention, the polyether component can be added to a fuel composition to enhance the water tolerance to the level needed for the intended application. As can be seen from FIG. 1, in which the water tolerance of a fuel comprised of 95% by volume gasoline and 5% by volume polyether is graphically illustrated, the fuel composition has lower water tolerance with increasing temperature. This will be characteristic of fuel compositions prepared using most polyethers employed in the present invention. Accordingly, to insure that satisfactory water tolerance is provided over the temperature range involved in the end use application, the fuel composition should be tested at elevated temperatures to determine whether the fuel composition containing the expected level of water remains a single phase, homogeneous material.

Pursuant to a more specific aspect of the present invention, the polyether is added together with a supplemental fuel component having a research blending octane number in excess of 100 to provide a fuel composition of enhanced water tolerance. Contrary to the water tolerance of the fuel composition containing the polyether as the sole added component, as seen in FIG. 1, a fuel composition including a supplemental fuel component will usually have a greater water tolerance as the temperature increases. Accordingly, it will be generally desirable to select the amounts of the particular polyether and supplemental fuel component such that the water tolerance is essentially constant, e.g., within 10 or 20% or so, over the expected application temperature range. Composition I in FIG. 2 demonstrates such a fuel composition at the particular water level involved. Conceptually, a composition of essentially constant water tolerance should be provided when the amounts of the polyether and the supplemental fuel component absorb water to provide a combined zero heat of solution.

Of course, if desired for a particular application, relatively constant water tolerance need not be provided. Satisfactory performance can be insured by adding the maximum expected level of water to a sample of the fuel composition under consideration and testing over the temperature range anticipated to verify that the composition remains a stable, single phase solution.

In blending a fuel composition in accordance with the invention, the order in which the components are combined is not critical. Upon combining the components, they tend to spontaneously form a solution. Accordingly, it is not necessary to use expensive homogenization equipment, although some stirring is useful.

It should be appreciated that a variety of other additives may be added to the fuel composition, if desired. Many such fuel additives are known for various purposes. Such additives can be employed, so long as the desired water tolerance characteristics of the compositions of this invention are not unduly adversely affected.

The following examples are illustrative of, but not in limitation of, the present invention. FIGS. 1 and 2 set forth graphs of the data generated from several of the Examples. These are merely for sake of illustration in understanding the trend of the data. For sake of comparison, literature ($A_1$, $A_2$, $A_1'$, $A_2'$, $A_1''$ and $A_2''$) and calculated ($A_3$, $A_3'$ and $A_3''$) values of the water tolerance for gasohol compositions containing various amounts of ethanol have been provided.

Examples 1, 2 and 3 illustrate the effect of temperature on the water tolerance of a fuel composition in accordance with the invention that is comprised of 95% by volume unleaded gasoline and 5% by volume of a suitable polyether.

EXAMPLE 1

In this Example the water tolerance of a fuel composition in accordance with the invention was determined at 2° C.

A solution was made by combining 95 parts by volume of unleaded gasoline with 5 parts by volume of a polyether. The polyether was analyzed as ethoxylated octyl or nonylphenol having 4 to 5 moles of ethylene oxide per mole of alkylphenol. 100 parts by volume of this solution at about 2° C. were placed in a flask, and water was added dropwise to the solution. After the addition of 4.7 parts by volume of water, the mixture began to cloud indicating the separation of an aqueous phase.

On a volume basis, the final composition, at the point at which the mixture began to cloud was:

90.7%: Unleaded gasoline
4.8%: polyether
4.5%: water

As can be seen, the tolerance for water of the initial fuel composition, containing 5% by volume of polyether, was 4.7% at 2° C. based on the composition before any water was added. The water tolerance of this composition is plotted as point 1 in FIGS. 1 and 2.

EXAMPLE 2

In this Example the water tolerance of the same initial fuel composition used in Example 1 was determined at 21° C. A solution was made by combining 5 parts by volume of the polyether used in Example 1 with 95 parts by volume of unleaded gasoline. 100 parts by volume of this solution were placed in a flask, and water was added dropwise to the solution at 21° C. After the addition of 3.7 parts by volume of water, the mixture began to cloud, indicating the separation of an aqueous phase. When the mixture was cooled below 21° C., the cloudiness spontaneously disappeared. The composition remained a single phase when cooled to about 0° C. When the mixture was warmed again to 21° C. or above, the cloudiness reappeared.

On a volume basis the final composition, at the point at which the mixture began to cloud, was:

91.6%: unleaded gasoline
4.8%: polyether
3.6%: water

As is shown, the tolerance for water of the initial fuel composition, containing 5% by volume of polyether, was 3.7% at 21° C. based on the volume of the composition before any water was added. The water tolerance of this composition is plotted at point 2 in FIGS. 1 and 2. The fact that the composition spontaneously cleared when cooled below 21° C. shows that a solution was formed, as opposed to an emulsion. This Example also shows that the solubility of water in a fuel composition in accordance with the invention increases as the temperature is decreased, and decreases when the temperature is increased.

EXAMPLE 3

In this Example the water tolerance of the same initial fuel used in Example 1 was determined at 56° C. A solution was made by combining 5 parts by volume of the polyether used in Example 1 with 95 parts by volume of unleaded gasoline. 100 parts by volume of this solution were placed in a flask, and water was added dropwise to the solution at 56° C. After the addition of 2.5 parts by volume of water, the mixture began to cloud, indicating the separation of an aqueous phase. When this fuel composition was cooled below 56° C., the cloudiness spontaneously disappeared. The composition remained a single phase when cooled to about 0° C. When the composition was warmed again to about room temperature, but below 56° C., no phase separation occurred.

On a volume basis, the final composition, at the point at which the mixture began to cloud, was:

92.7%: unleaded gasoline
4.9%: polyether
2.4%: water

As shown, the tolerance for water of the initial fuel composition, containing 5% by volume of polyether, was 2.5% by volume at 56° C. based on the volume of the composition before any water was added. The water tolerance of this composition is plotted as point 3 in FIGS. 1 and 2.

Examples 1–3 together show that the solubility of water in a fuel composition in accordance with the broadest aspect of this invention increases when the temperature is decreased, and decreases when the temperature is increased. It is significant that the compositions spontaneously cleared when cooled. This demonstrates that they formed solutions as opposed to two phase mixtures such as emulsions. The variance in water tolerance with temperature exhibited by the polyether-containing compositions is the opposite of that observed when a fuel composition contains ethanol as the only added component, as seen in FIG. 1.

EXAMPLE 4

This Example illustrates the preparation of gasohol using nonanhydrous alcohol in accordance with the invention.

100 parts by volume of unleaded gasoline and 10.2 parts by volume of 95% ethyl alcohol were combined in a flask. A cloudy mixture resulted. The polyether of Example 1 was added dropwise to the mixture at 68° F. with continuous gentle shaking. After addition of 2.0 parts by volume of the polyether, a clear solution was produced.

On a volume basis, the resulting gasohol was comprised of:

88.4%: unleaded gasoline
2.6%: polyether
8.55%: ethyl alcohol
0.45%: water

When a sample of the solution was centrifuged at high speed, no phase separation occurred. This composition is plotted as point C in FIG. 2.

This Example shows that addition of a suitable polyether component to a gasohol fuel composition in accordance with the present invention affords increased tolerance for water in comparison to the water tolerance of the gasohol fuel composition itself. This Example also shows that gasohol can be prepared using nonanhydrous alcohol when a suitable polyether is included in the composition as called for by the present invention.

EXAMPLE 5

This Example illustrates preparation of a fuel composition comprised of unleaded gasoline and a suitable polyether in accordance with the invention having a predetermined significant tolerance for water.

100 parts by volume of unleaded gasoline and 10 parts by volume of water were combined in a flask, producing two phases. The polyether used in Example 1 was added dropwise to the mixture at 68° F. with continuous gentle shaking. After addition of 7.5 parts by volume of the polyether, a clear solution was produced. When a sample of the solution was centrifuged at high speed, no phase separation occurred. This composition is plotted as point D in FIG. 2. On a volume basis, the final composition, at the point at which a clear solution resulted, was:

85.1%: unleaded gasoline
6.4%: polyether
8.5%: water

This Example again shows that the water tolerance of gasoline is increased by addition of a suitable polyether. Based on this Example, it could be predicted that a fuel composition comprised of 100 parts by volume of unleaded gasoline and 7.5 parts by volume of the polyether (or 93% gasoline and 7% polyether) would tolerate 9.3% water based on the volume of the composition before any water was added.

EXAMPLE 6

This Example illustrates a fuel composition in accordance with the present invention prepared using diesel fuel. 100 parts by volume of diesel fuel and 10 parts by volume of water were combined in a flask. A two phase mixture resulted. The polyether used in Example I was added dropwise to the mixture at 70° F. After addition of 13.25 parts by volume of polyether, a clear solution was produced. A sample of the solution was centrifuged at high speed, but no phase separation was observed. On a volume basis, the final composition, at the point at which a clear solution was produced, was:

80%: diesel fuel
12%: polyether
8%: water

This composition is plotted for comparison as point E in FIG. 2.

This Example shows that compositions in accordance with the invention can be prepared using hydrocarbon base fuels other than gasoline.

EXAMPLE 7

This Example illustrates preparation of a gasohol having improved water tolerance in accordance with the invention using another suitable polyether.

90 cc of unleaded gasoline, 14.0 cc of polyether and 9.7 cc of water were combined in a flask and stirred at about 65° F. producing a very hazy mixture. The polyether used comprised 10.5 cc of Triton N-57, an ethoxylated nonylphenol having 5 moles of ethylene oxide per mole of nonylphenol (manufactured by Rohm & Haas), and 3.5 cc of Triton N-101, an ethoxylated nonylphenol having 9 to 10 moles of ethylene oxide per mole of nonylphenol (manufactured by Rohm & Haas). 7.3 cc of 95% ethyl alcohol were then added, and after stirring a clear solution was produced.

On a volume basis, this fuel composition was comprised of:

74.4%: unleaded gasoline
11.6%: polyether
5.7%: ethyl alcohol
8.3%: water

The solution remained clear when cooled to about 0° F. The temperature range over which this composition remained a stable, one phase solution is indicated by line F in FIG. 2.

As shown, various polyethers can be used in combination to provide a suitable polyether mixture for use in preparing fuel compositions in accordance with the invention.

Examples 8, 9 and 10 illustrate three fuel compositions, prepared at ambient temperatures in accordance with the present invention which were phase-stable down to about 0° F. The total amount of the components (polyether, alcohol and water) added to the hydrocarbon base fuel was 28% by volume in each case. These Examples also illustrate successful use of various polyethers and alcohols.

EXAMPLE 8

90 cc of unleaded gasoline, 18 cc of the polyether used in Example 1, 10 cc of water and 7 cc of ethyl alcohol were combined in a flask. On a volume basis, this fuel composition was comprised of:

72.0%: unleaded gasoline
14.4%: polyether
5.6%: ethyl alcohol
8.0%: water

This composition was a bright and clear solution at laboratory temperature, 62° F. The solution remained a bright, clear, one phase solution when cooled to −1° F. The temperature range over which this composition was shown to be a single phase solution is indicated by line G in FIG. 2.

EXAMPLE 9

This Example illustrates preparation of a fuel composition in accordance with the invention using another suitable polyether and using isopropyl alcohol instead of ethyl alcohol.

90 cc of unleaded gasoline, 18 cc of polyether, 7 cc of alcohol, and 10 cc of water were combined in a flask and stirred at about 64° F. The polyether used was a mixture of 9 cc of Triton X-45, an ethoxylated octylphenol having 5 moles of ethylene oxide per mole of octyl phenol, and 9 cc of Triton X-114, an ethoxylated octyl phenol having 7 to 8 moles of ethylene oxide per mole of octylphenol. Both Triton X-45 and Triton X-114 are manufactured by Rohm & Haas. On a volume basis, this fuel composition was comprised of:

72%: unleaded gasoline
14.4%: polyether
5.6%: isopropyl alcohol
8.0%: water

This composition was a bright and clear solution at laboratory temperature, 64° F., and remained so when cooled to about −1° F. The temperature range over which this composition was demonstrated to be a single phase solution is also indicated by line G in FIG. 2.

EXAMPLE 10

This Example illustrates preparation of a fuel composition in accordance with the invention using the polyethers described in Example 7 and using isopropyl alcohol instead of ethyl alcohol.

90 cc of unleaded gasoline, 18 cc of polyether and 10 cc of water were combined in a flask, producing a hazy mixture. To this mixture, 7 cc of isopropyl alcohol were added, and a completely clear solution resulted. The polyether comprised a mixture of 9 cc of Triton N-57 and 9 cc of Triton N-101. On a volume basis, this fuel composition was comprised of:

72%: unleaded gasoline
14.4%: polyether
5.6%: isopropyl alcohol
8.0%: water

This composition was a bright, clear, one phase solution at laboratory temperature and when cooled to about −1° F. Line G in FIG. 2 indicates the temperature range over which this composition (in addition to the compositions of Examples 8 and 9) was demonstrated to remain a single phase solution.

Examples 11, 12 and 13 illustrate fuel compositions which did not remain single phase solutions over the temperature range tested.

EXAMPLE 11

This Example illustrates a fuel composition that is unstable at low temperatures, and illustrates one of the potential limitations imposed by using a large amount of polyether. 90 cc of unleaded gasoline, 7 cc of isopropyl alcohol, 18 cc of the polyether used in Example 1, and 10 cc of water were combined in a flask. On a volume basis, this fuel composition comprised:

72%: unleaded gasoline
14.4%: polyether
4.6%: isopropanol
8.0%: water

The fuel composition was a bright, clear solution at laboratory temperature. When cooled to about −1° F., for several hours, a single liquid phase remained, but cubic crystals had deposited out. It is believed that the material that crystallized out was the hydrated polyether, and that the danger of this occurring is reduced when lower levels of polyether are used.

EXAMPLE 12

This Example illustrates a fuel composition that is unstable at room temperature as a result of adding an amount of water in excess of the water tolerance imparted by the particular polyether and alcohol used.

90 cc of gasoline, 9 cc of polyether, 10 cc of water, and 7 cc of isopropanol were combined in a flask. The polyether comprised a mixture of 6 cc of Triton X-45 and 3 cc of Triton X-114 (these polyethers were also used in Example 9). On a volume basis, this fuel composition comprised:

77.6%: unleaded gasoline
7.8%: polyether
6.0%: isopropyl alcohol
8.6%: water

Even after continued stirring, this mixture did not clear. After standing 20 minutes, 2 separate layers could be detected. The separation could have been avoided by adding a lower percentage of water, using a greater percentage of polyether, or using a polyether mixture having a more optimum balance in its affinity for the hydrocarbon base fuel and alcohol on the one hand and water on the other.

EXAMPLE 13

This Example illustrates a comparative fuel composition which is an unstable emulsion. 90 cc of unleaded gasoline, 18 cc of polyether, 7 cc of isopropyl alcohol, and 10 cc of water were mixed at room temperature and stirred for 10 minutes until the mixture became a clear fluid. It remained clear even when cooled to about 0° F. However, on rewarming to room temperature, the clear fluid de-emulsified to yield two distinct liquid phases.

On a volume basis this unstable emulsion comprised:

72%: unleaded gasoline
14.4%: polyether
5.6%: isopropyl alcohol
8.0%: water

The polyether used was a 50-50 mixture of Triton X-57 (described in Example 7) and Triton X-165. Triton X-165 is an ethoxylated octyl phenol having an average of 16 moles of ethylene oxide or mole. Triton X-165, although an excellent emulsifier, is preferentially water soluble and is unsuitable as a major component of the polyether useful in this invention.

EXAMPLE 14

This Example illustrates a further gasohol having enhanced water tolerance in accordance with the invention made using isopropyl alcohol instead of ethyl alcohol. 90 cc of unleaded gasoline and 10 cc of isopropanol were combined in a flask at 70° F. To this solution, 18 cc of the polyether used in Example 1 and 10 cc of water were added with constant mixing. A bright, clear, one phase solution was produced. On a volume basis, the final composition was:

70.3%: unleaded gasoline
14.1%: polyether
7.8%: isopropanol
7.8%: water

When this composition was cooled to −4° F. it remained a clear, single phase solution. The temperature range over which it was demonstrated that this composition is stable is indicated by line H in FIG. 2.

EXAMPLE 15

This Example illustrates the broad temperature range over which a gasohol composition in accordance with the invention can tolerate a significant quantity of water.

95 parts by volume of unleaded gasoline and 5 parts by volume of the polyether used in Example 1 were combined in a flask, producing a clear solution. 95% ethyl alcohol was added in small aliquots at 68° F. with continuous gentle shaking. After addition of 39.7 parts by volume of polyether, the solution was still clear.

On a volume basis, this fuel composition was comprised of:

68%: unleaded gasoline
3.6%: polyether
27%: ethyl alcohol
1.4%: water

No phase separation was observed when the solution was cooled to about 0° F. or warmed to about 130° F. The temperature range over which this composition was shown to remain a stable, single phase solution is plotted as line I in FIG. 2.

This Example shows that a gasohol fuel composition to which a suitable polyether is added retains its increased tolerance over a significant temperature range. This is in contrast to the limited water tolerance for gasohol fuel compositions not including a suitable polyether as seen from the literature and calculated values shown in FIGS. 1 and 2.

Thus, as has been shown, the present invention provides a fuel composition having improved tolerance for water over a wide range of temperatures. More particularly, the invention provides a gasohol that can be blended from nonanhydrous alcohol without causing separation of an aqueous alcohol phase. The invention also provides the ability to significantly reduce precautions to exclude water that were previously and typically required in blending, storing, and transporting gasohol.

I claim as my invention:

1. A fuel composition comprising a major amount of a hydrocarbon base fuel, up to about 20% by volume of a supplemental fuel component having a research blending octane number in excess of about 100 and at least about 1% by volume of a polyether more soluble in said hydrocarbon base fuel than in water, said fuel composition being capable of tolerating water in an amount greater than the tolerance of a blend of the hydrocarbon base fuel and the supplemental fuel component.

2. The fuel composition of claim 1 wherein said polyether is present in an amount of from about 1 to 15% by volume.

3. The fuel composition of claim 2 wherein said polyether is present in an amount of from about 2 to 5% by volume.

4. The fuel composition of claim 1 wherein said polyether is a polyalkylene oxide polyether.

5. The fuel composition of claim 4 wherein said polyether is an ethoxylated alkyphenol.

6. The fuel composition of claim 5 wherein the ethoxylated alkylphenol is an ethoxylated octylphenol having an average of about 3 to 5 moles of ethylene oxide per mole of octylphenol.

7. The fuel composition of claim 1 wherein said supplemental fuel component is an alcohol selected from the group consisting of methyl, ethyl, isopropyl and mixtures thereof.

8. The fuel composition of claim 1 wherein the hydrocarbon base fuel is unleaded gasoline.

9. A method of preparing a fuel composition which comprises blending a major amount of a hydrocarbon base fuel with up to about 20% by volume of a supplemental fuel component having a research blending octane number in excess of about 100 and containing water and adding thereto at least about 1% by volume of a polyether more soluble in the hydrocarbon base fuel than in water, said polyether being present in an amount sufficient to provide a single phase fuel composition.

10. A fuel composition comprising a major amount of a hydrocarbon base fuel and at least about 1% by volume of a polyether more soluble in the hydrocarbon base fuel than in water, said fuel composition being capable of tolerating water in an amount greater than that of the hydrocarbon base fuel.

11. An additive for imparting increased water tolerance to a fuel composition containing a hydrocarbon base fuel and having a certain, anticipated amount of water comprising a mixture of a supplemental fuel component having a research blending octane number in excess of about 100 and a polyether more soluble in a hydrocarbon base fuel than in water, the relative amounts of said supplemental fuel component and said polyether being capable of providing a single phase composition upon addition to said fuel composition.

12. The additive of claim 11 wherein said polyether is a polyalkylene oxide polyether.

13. The additive of claim 12 wherein said polyalkylene oxide polyether is an ethoxylated alkylphenol.

14. The additive of claim 13 wherein said ethoxylated alkylphenol is an ethoxylated octylphenol having an average of about 3 to 5 moles of ethylene oxide per mole of octylphenol.

15. The additive of claim 11 wherein said supplemental fuel component is an alcohol selected from the group consisting of methyl, ethyl, isopropyl and mixtures thereof.

16. The additive of claim 15 wherein said supplemental fuel component contains water.

17. The additive of claim 11 wherein the said supplemental fuel component and polyether are present in relative amounts capable of imparting to a fuel composition essentially constant water tolerance over a temperature range of at least 0° to 100° F.

* * * * *